United States Patent [19]

Kober

[11] 4,073,486

[45] Feb. 14, 1978

[54] FOLDER CONSTRUCTION

[75] Inventor: Kasimir Kober, Chicago, Ill.

[73] Assignee: Chicago Dryer Company, Chicago, Ill.

[21] Appl. No.: 728,079

[22] Filed: Sept. 30, 1976

Related U.S. Application Data

[63] Continuation-in-part of Ser. No. 570,058, April 21, 1975, abandoned.

[51] Int. Cl.[2] ..... B65H 45/00

[52] U.S. Cl. ..... 270/69; 270/80; 270/83

[58] Field of Search ..... 270/62, 66, 67, 69, 270/68 R, 80–85

[56] References Cited

U.S. PATENT DOCUMENTS

| | | | |
|---|---|---|---|
| 2,629,591 | 2/1953 | Kahn | 270/81 |
| 2,650,821 | 9/1953 | Howlett | 270/68 R |
| 3,134,587 | 5/1964 | Sjostrom | 270/62 |
| 3,260,518 | 7/1966 | Kamberg | 270/62 |
| 3,361,424 | 1/1968 | Kamberg | 270/68 R |
| 3,363,897 | 1/1968 | Northern | 270/69 |
| 3,414,138 | 12/1968 | Junemann | 214/6 DK |
| 3,437,334 | 4/1969 | Maldonado | 270/69 |
| 3,452,979 | 7/1969 | Grantham | 270/62 |
| 3,462,138 | 8/1969 | Grantham | 270/62 |
| 3,485,492 | 12/1969 | Iltis | 270/84 |
| 3,517,919 | 6/1970 | Flygare | 270/68 R |
| 3,642,270 | 2/1972 | Patton | 270/62 |
| 3,754,750 | 8/1973 | Sjostrom | 270/69 |
| 3,905,593 | 9/1975 | Behn | 270/62 |

*Primary Examiner*—Edgar S. Burr
*Assistant Examiner*—A. Heinz
*Attorney, Agent, or Firm*—Neuman, Williams, Anderson & Olson

[57] ABSTRACT

A folding apparatus for laundry items such as sheets or the like employs a feed conveyor of continuous tapes or ribbons arranged at an incline. The leading edge of the fed sheet drops by gravity from the upper conveyor end. A blast from an adjacent air bar forces the longitudinal mid-point of the sheet to move onto a second conveyor substantially parallel to the feed conveyor and proceed toward the initial feed station whereat the once-folded sheet drops in front of a second air bar which forces the mid-point of such sheet onto a lower, third conveyor leading away from the feed station. The twice-folded sheet is then driven into the bite of pinch rolls disposed beneath the third conveyor and is folded twice more by buckle folders in the course of proceeding to a stacking means of simplified design. The air bars instrumental in effecting the first two folds are actuated by measuring means employed in combination with sheet-sensing means as will hereinafter be explained in greater detail.

3 Claims, 11 Drawing Figures

FIG. 1
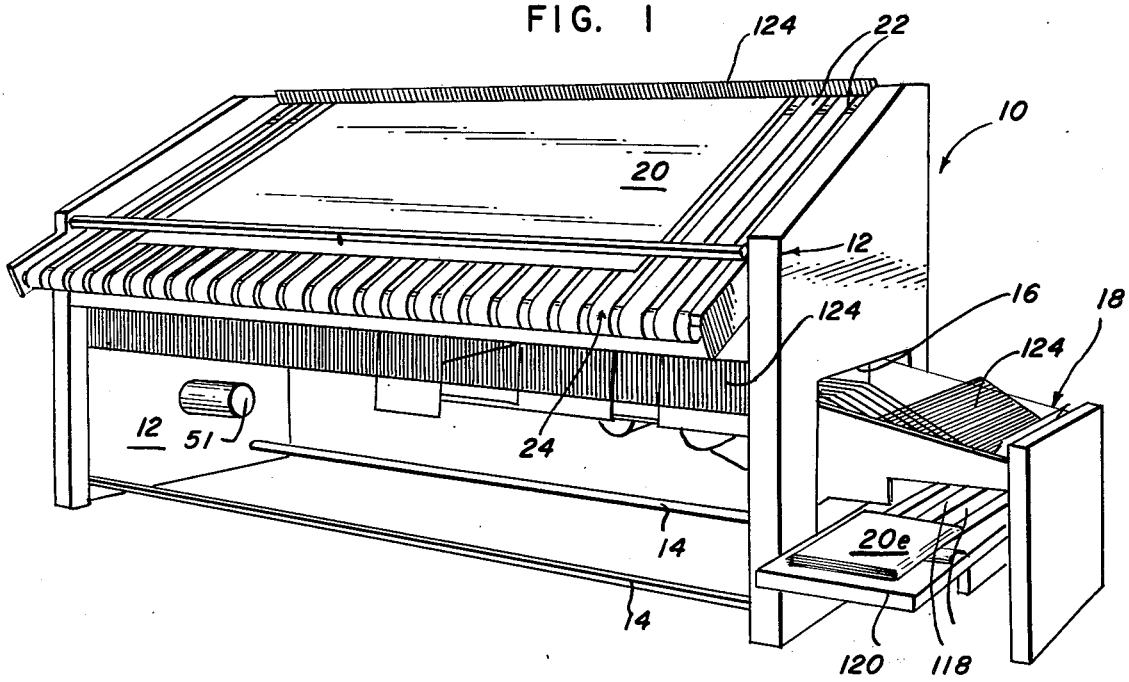
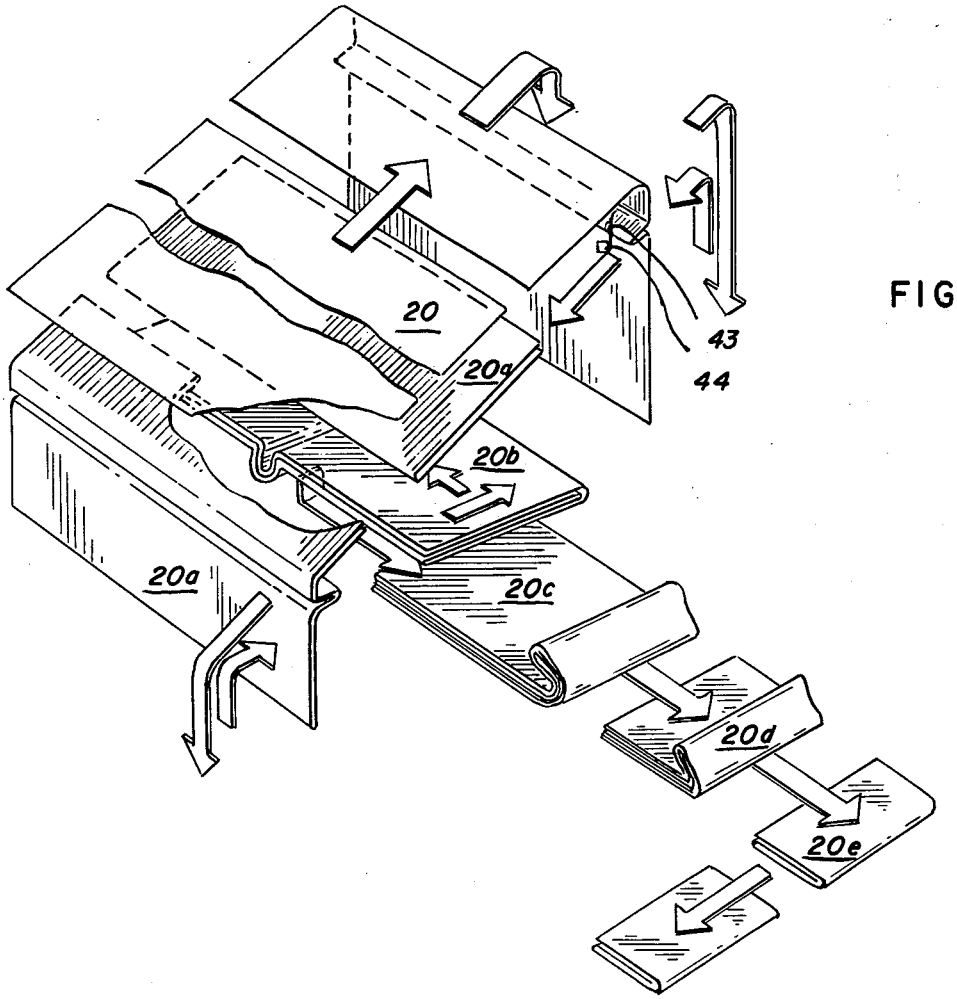
FIG. 2

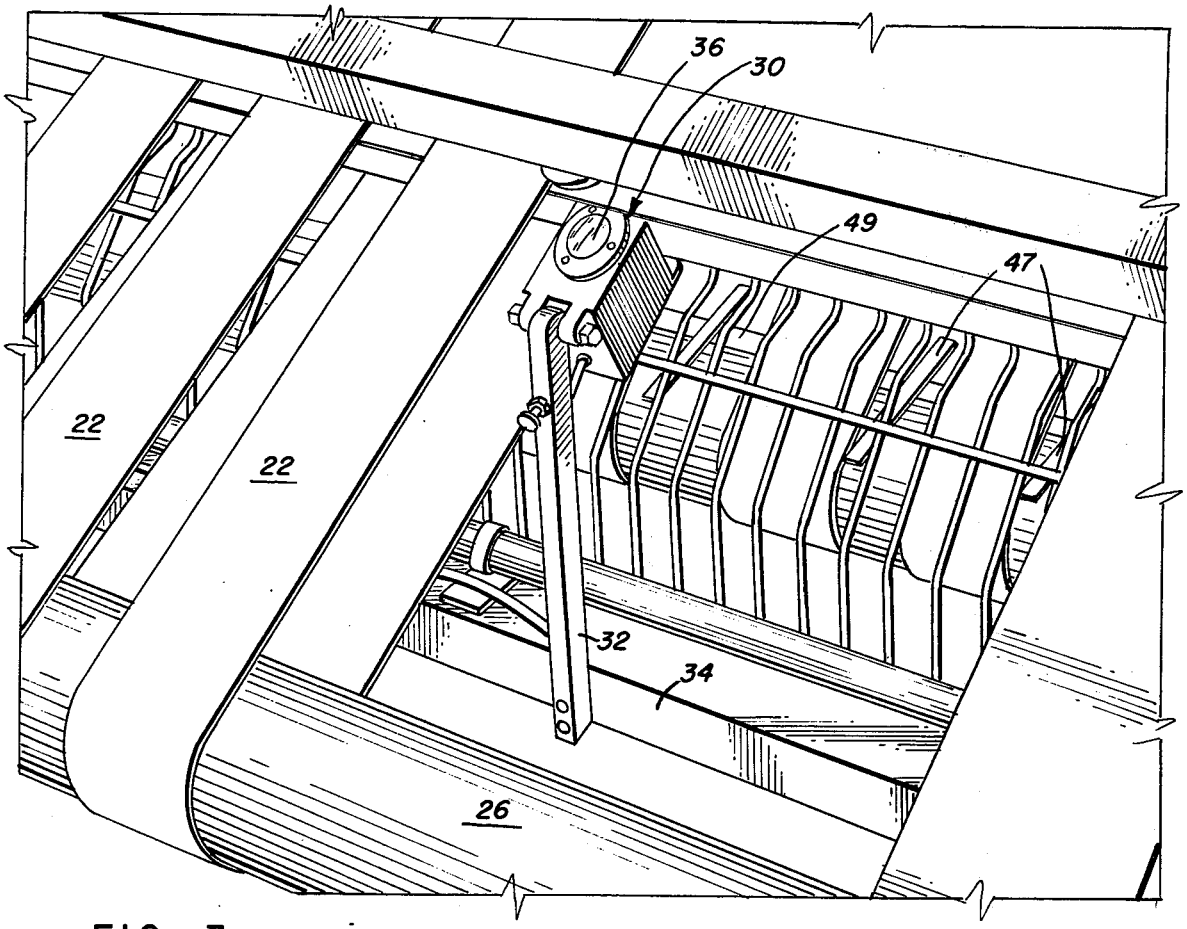
FIG. 3
FIG. 4
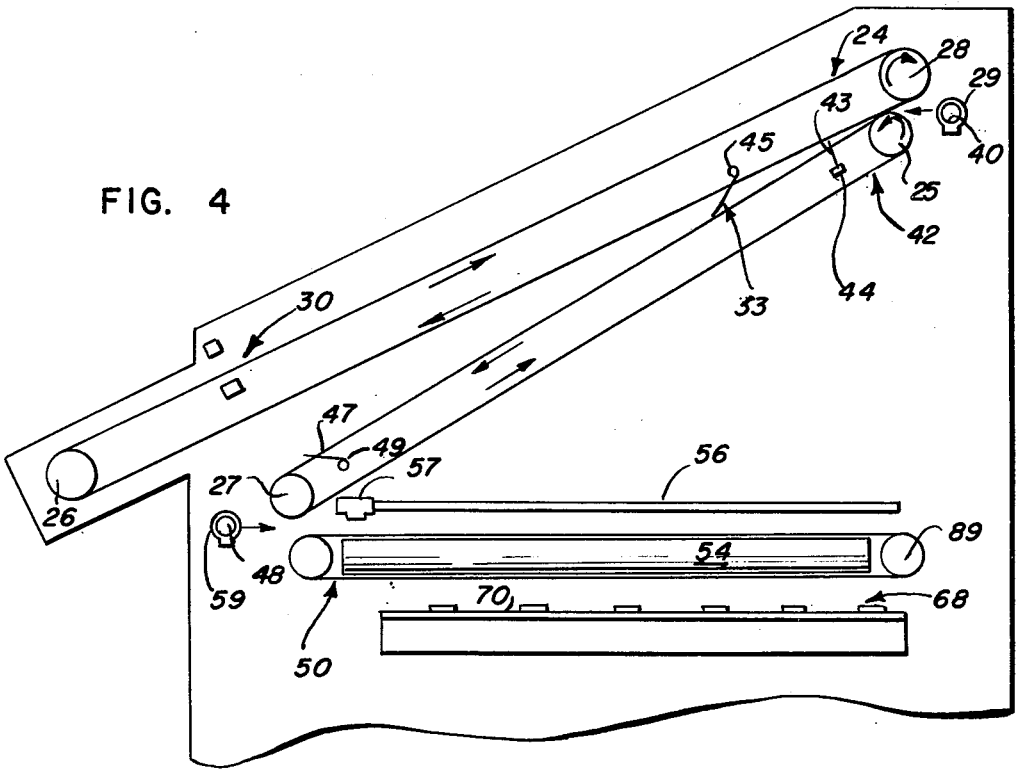

FIG. 8
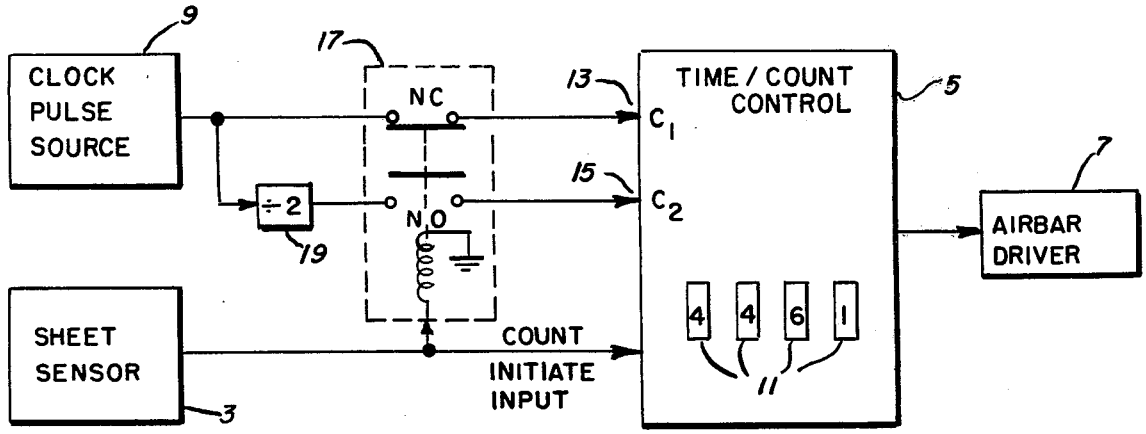
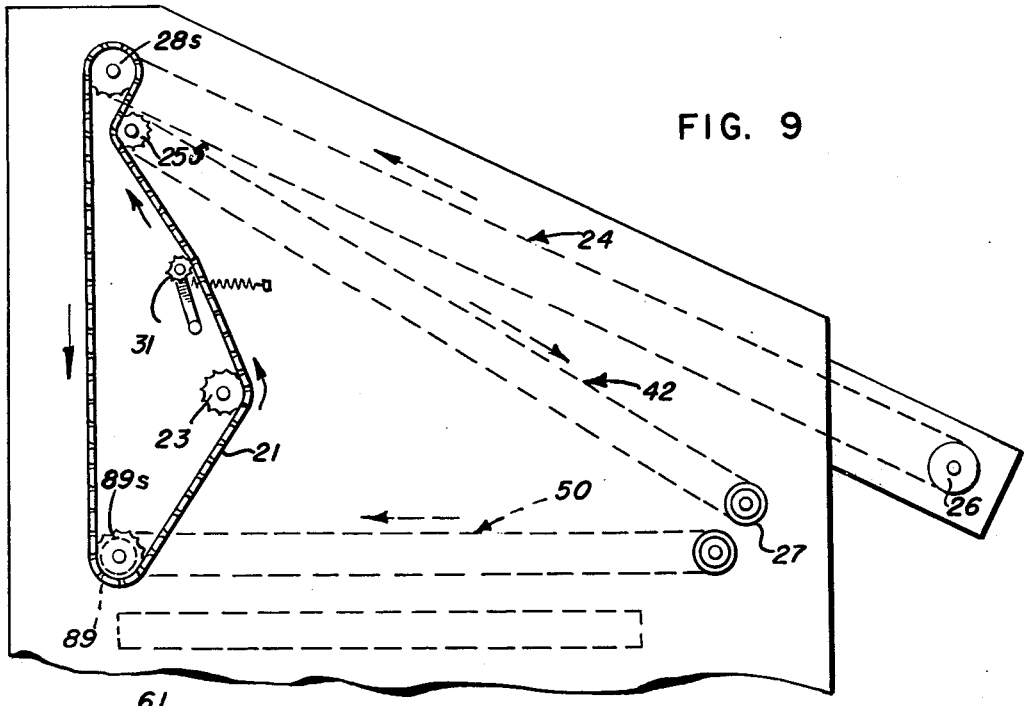
FIG. 9
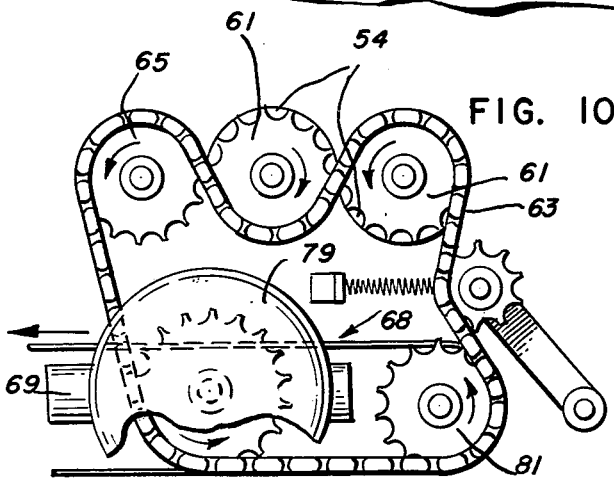
FIG. 10
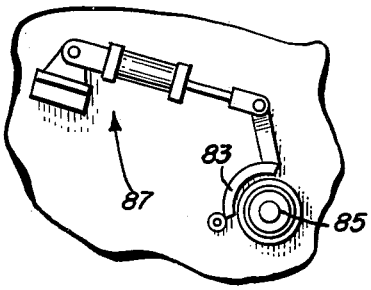
FIG. 11

FOLDER CONSTRUCTION

This invention relates to folding apparatus and is a continuation-in-part of my pending application Ser. No. 570,058, filed Apr. 21, 1975 now abandoned. More specifically, this application is directed to a folding apparatus of compact design adapted to efficiently form a plurality of folds in foldable items such as textile articles while occupying a minimum amount of valuable floor space in a place of use such as a laundry or the like.

A variety of folding apparatus for folding textile items is well-known in the art. However, quite often machines of the prior art although adapted to fold foldable items such as sheets a plurality of times are rather large and at times massive. Undesirable machine size has obvious disadvantages such as the occupying of large areas of valuable floor space. Also, if the machines are of excessive height, little room is available for a workman to maintain and repair the various moving apparatus elements, thereby rendering optimum machine operation a difficult matter.

Prior art folding devices such as that disclosed in Kamberg U.S. Pat. No. 3,361,424 although adapted to reliably form a plurality of folds in a foldable laundry item such as a bedsheet or the like, are rather large in exterior dimensions occupying a large floor area and room volume.

A main feature of the provided folding apparatus comprises a novel stacking mechanism used in conjunction with the various folding stations of the hereinafter described device. The provided stacking apparatus includes a single platform of spaced supporting fingers which is substantially instantaneously movable upon reception thereon of a folded textile article such as a bedsheet of the like which has been folded by the main apparatus elements.

Although the prior art has long employed stacking apparatus for use in conjunction with folding machines of the type hereinafter described, such stacking devices were normally of complex, expensive manufacture which included a large number of separate working parts not only contributing to the large initial cost, but also rendering maintenance of the same difficult and expensive.

By way of example, Junemann et al U.S. Pat. No. 3,414,138 discloses a device for automatically stacking workpieces in which a folded textile article is forceably moved through a series of movements by apparatus components, which move the folded article through various positions prior to stacking the same on a stacking platform. The folded article in Junemann is forced to follow a "quadrangular path" wherein a folded textile article is slidably moved unto the supporting rods whereafter the supported workpiece is stripped from the rods into a vertical stack.

Another relatively complex stacker apparatus is disclosed in Kamberg U.S. Pat. No. 3,361,424 which stacker employs a plurality of components for purposes of forming a stack able to be formed by the stacker hereinafter described in detail. The stacker hereinafter disclosed is composed of a minimum number of parts requiring little in the way of maintenance.

It is an object of this invention, therefore, to provide a folding apparatus employing a novel stacker which efficiently forms a plurality of folds in a foldable textile article such as a sheet or the like, as the sheet is rapidly conveyed through the various folding stations of the apparatus.

It is another object of this invention to provide a folding apparatus in which safeguards are provided throughout the passage of the foldable articles through the device, substantially completely obviating any danger of the foldable article jamming in various movable elements of the provided apparatus.

It is a still further object of this invention to provide a folding apparatus adapted to efficiently form a plurality of folds in a foldable textile article, which apparatus is compact in design, occupying a minimum amount of valuable floor space. The provided apparatus utilizes a small number of reliable parts of long life so that the resultant machine is extremely durable and extremely simple to maintain.

It is yet another object of this invention to provide a stacker of simplified design in which a single reciprocating platform in conjunction with a vertical stop surface is able to form a neat vertical stack of foldable articles upon receiving such articles discharged from the folding apparatus of the provided invention.

It is still another object of this invention to provide a folding apparatus employing novel actuating means for effecting folds in a moving foldable article, such actuating means being able to be precisely controlled so that an exact portion of the foldable article is always engaged by the folding means for purposes of forming the desired folds.

The above and other objects of this invention will become apparent from the following detailed description when read in the light of the accompanying drawings and appended claims.

In one embodiment of a folding apparatus made in accordance with this invention, the edge of a foldable article such as a sheet or the like, is fed onto a constant-speed feed conveyor which is upwardly inclined at an angle of approximately 28° from the horizontal. In the course of being fed onto the initial portion of the feed conveyor the sheet passes over an electric eye, thereby actuating a time/count control, such control being deactivated for sheet measurement upon passage of the sheet terminal edge over said eye. The length of the sheet is precisely calculated in terms of the counts or time it takes the feed conveyor to move one-half of such sheet over the electric eye. This time comprises a "delay" added to the time expended for a point on the feed conveyor to move from the electric eye to an air bar adapted to emit a blast of air for sheet-folding purposes. Thus the control actuates a solenoid to allow air passage into the air bar when the sheet mid-point is precisely opposite such bar.

Accordingly, as the foldable article moved by the constantly moving feed conveyor drops from the raised terminal end of such feed conveyor, the air bar disposed adjacent such feed conveyor terminal end and adjacent the beginning of an underlying second conveyor feed end is activated by the control to drive the mid-point of the conveyed sheet onto the second conveyor which is angled downwardly toward the initial feed station.

A second air bar is disposed at the lower end of the second conveyor. In the course of moving onto the second conveyor, a switch actuator is tripped by the leading edge of the half-folded sheet which is in communication with a second time/count control which effectively measures one-half the length of the half-folded sheet in terms of counts. The length measurement is terminated when the trailing edge of the half-folded sheet leaves engagement with such switch.

When the mid-point of the half folded sheet drops from the terminal end of the second conveyor beneath the initial feed end of the apparatus, an appropriately positioned air bar drives the mid-point of such half-folded sheet onto a third conveyor moving to the rear of the apparatus.

The flexible article which has now been twice transversely folded engages an actuating switch in the course of movement over the third conveyor thereby activating a brake for the third conveyor, and while the twice folded sheet is at rest, an air bar disposed over the twice folded sheet drives the transverse mid-point of the same down between counter-rotating pinch rolls for discharge unto an underlying fourth conveyor which moves the thrice folded sheet transversely of the apparatus upper conveyors toward a discharge opening. In the course of moving on the fourth conveyor the thrice-folded sheet engages two series of buckling folders which engage the leading edge of such textile article and drop the same on the trailing edge as the same is moved by the fourth conveyor so that the finally discharged foldable article has been folded five times.

Such folded article is driven from the end of the fourth conveyor onto an underlying stacking platform comprising spaced supporting fingers. In the course of slidably moving over the supporting fingers an actuating switch arm is tripped, substantially instantaneously retracting the supporting fingers. The leading edge of the final folded article slides toward a stop surface as the supporting fingers are withdrawn from therebeneath. Such action allows the folded article to drop in substantially the vertical plane with its forward edge aligned by the stop surface disposed at substantially right angles to the axes of the reciprocating fingers. The underlying articles may be stacked on an automatic conveyor which is actuated to move the formed stack after a predetermined number of reciprocations of the stacking platform, toward the operator who is feeding the articles onto the apparatus at the feed station.

For a more complete understanding of this invention reference will now be made to the drawings wherein:

FIG. 1 is a perspective view of a folding device and attached stacker mechanism made in accordance with the teaching of this invention;

FIG. 2 is a schematic representation of the path which a foldable article follows in the course of passage through the apparatus of FIG. 1 illustrating the various folds made therein;

FIG. 3 is an enlarged fragmentary perspective view illustrating an electric eye mechanism employed in the feed station of the apparatus of FIG. 1, some of the apparatus feed ribbons being removed for clarity of illustration;

FIG. 4 is a schematic representation of the various conveyors employed in the apparatus of FIG. 1 as viewed from the side;

Figure 6:
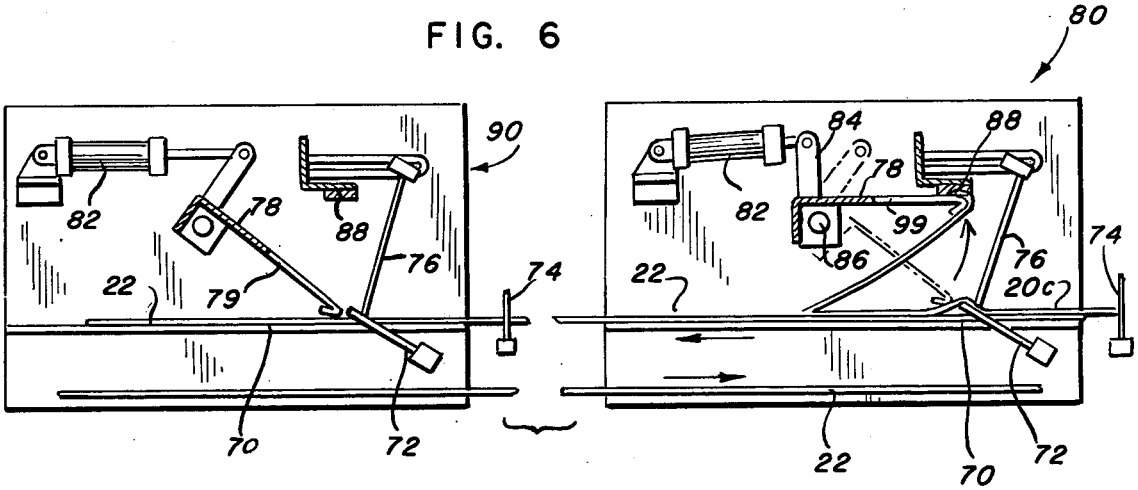
Figure 7:
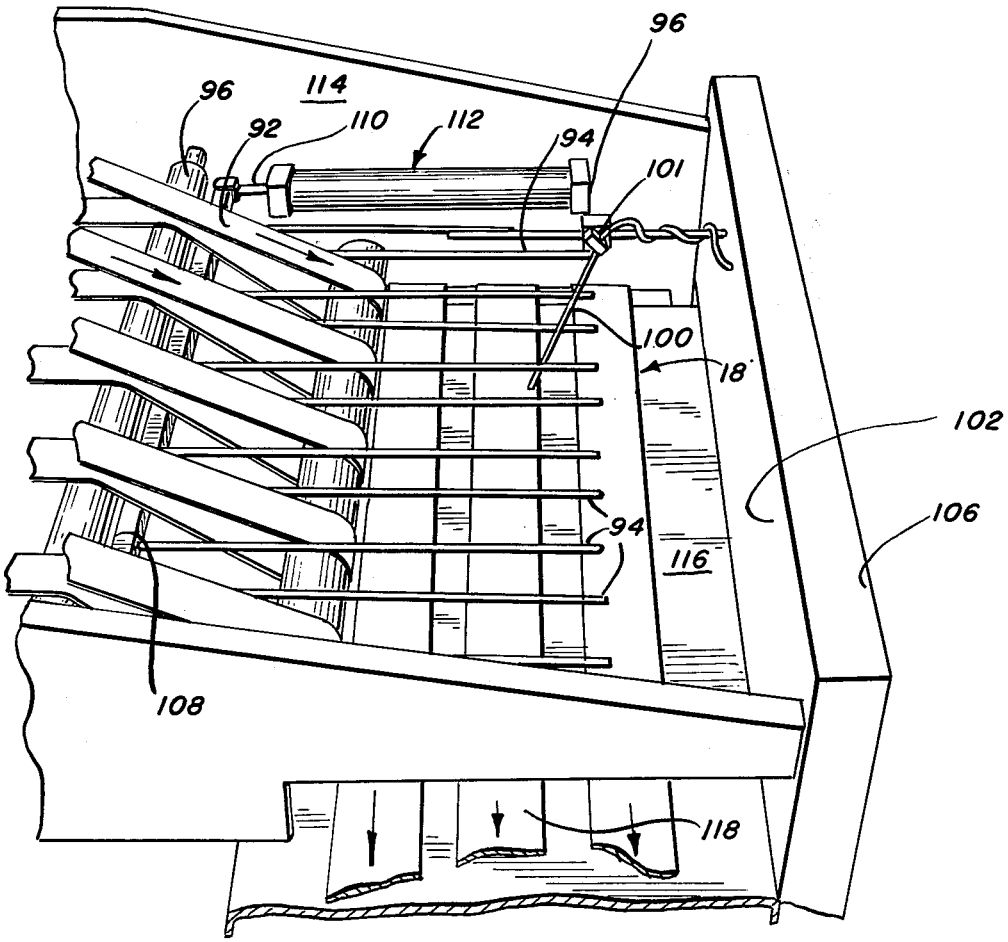

FIG. 6 comprises a fragmentary side elevational view of two buckling fold stations employed in conjunction with the final discharge conveyor of the apparatus of FIG. 1;

FIG. 7 comprises a fragmentary perspective view illustrating the stacking platform of the apparatus of FIG. 1;

FIG. 8 is a timing circuit of the type employed in conjunction with the apparatus of this invention in effecting the first two folds of a foldable article;

FIG. 9 is a schematic representation of conveyors employed in the provided apparatus illustrating a common drive chain for simultaneously driving the first three conveyors of such apparatus;

FIG. 10 is an end elevational view illustrating driving means for rotating pinch rolls for effecting a cross-fold in the provided apparatus; and FIG. 11 is a fragmentary view illustrating a brake means which may be employed for stopping the third conveyor of the apparatus while a cross-fold is effected.

Referring now more particularly to FIG. 1, a folding apparatus 10 is therein illustrated comprising opposed side frames 12 interconnected by reinforcing transverse spacer members 14. It will be noted that the right frame member 12 in FIG. 1 has a discharge opening 16 from which foldable textile articles folded by the apparatus 10 are discharged onto the stacking platform 18 more clearly seen in FIG. 7.

It will be noted from FIG. 1 that a foldable article such as illustrated sheet 20 may be fed onto the lower portions of continuous feed tapes or ribbons 22 defining an inclined feed conveyor 24. By virtue of the inclined arrangement of conveyor 24, a minimum of underlying valuable floor area is occupied by the apparatus 10. Continuous ribbons 22 rotatably engage constantly-rotating rollers 26 and 28 at the lower and upper ends respectively (see FIG. 4). Roller 26 is more clearly seen in FIG. 3 and upper roller 28 is more clearly seen in the rear elevational view comprising FIG. 5. Roller 28 has sprockets 28*s* secured to one end thereof disposed in one side frame 12 (see FIG. 9) which is driven by drive chain 21. Chain 21 is driven by sprocket 23 which is in turn driven by motor 51 illustrated in FIG. 1.

Figure 5:
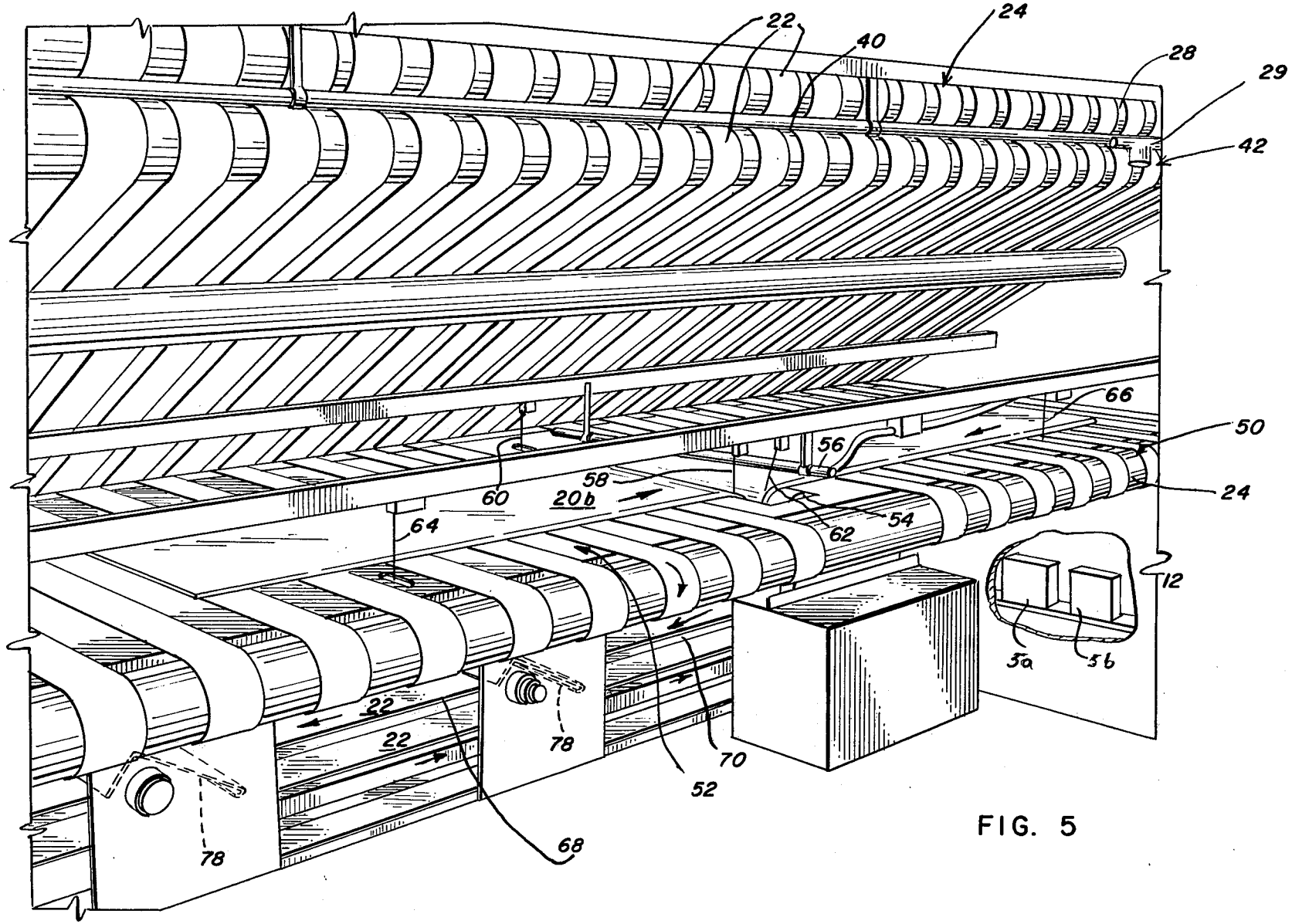
FIG. 5 is a fragmentary rear elevational view of the apparatus of FIG. 1.

In the course of being fed onto the inclined feed conveyor 24, the leading edge of a foldable article such as illustrated sheet 20 of FIG. 1, will pass over an electric eye 30 or equivalent sheet sensing means, drop by gravity from the upper end of conveyor 24 behind the rear of apparatus 10 illustrated in FIG. 5, whereafter an air blast from air bar 40 having an air passage therethrough controlled by solenoid 29 will drive the longitudinal mid-point of sheet 20 onto ribbons 22 of conveyor 42 (see FIGS. 4 and 5) effecting half fold and forming sheet 20*a* of FIG. 2 which is conveyed to the front of apparatus 10. Conveyor 42 is driven by drive roller 25 (FIG. 4) disposed at the upper portion of the conveyor opposite lower roller 27. Roller 25 has sprocket 25*s* mounted thereon (FIG. 9) and engages chain 21. Spring loaded and pivotally mounted sprocket 31 maintains desired tension in the drive chain as is also see in FIG. 9.

A second transverse half fold is formed as the leading edge of sheet 20*a* drops by gravity from the lower end of conveyor 42, and air bar 48 illustrated in FIG. 4 emits air which drives the mid-point of sheet 20*a* to a lower third conveyor 50 (see FIGS. 4 and 5) for subsequent processing. Air input bar 48 is controlled in part by sheet sensor or switch 44, see FIG. 4, which engages sheet 20*a* as the same moves on conveyor 42.

Referring now to FIG. 8, there is shown in block form a timing circuit of the type used for actuating solenoids for each of the air bars 40 and 48 creating the transverse folds of the sheets 20 and 20*a* during the folding processes at the leading portions of conveyors 42 and 50.

The timing circuit insures that an air blast for initiating the fold in each sheet will occur precisely as the middle of the passing sheet as measured along its axis of movement reaches the location of either air bar.

To this end, there is provided in conjunction with each of these first two folds of apparatus 10 a sheet sensor 3 which provides an output signal throughout the period during which the sheet passes the location of the sensor on the conveyor system. The sensor may be any of a variety of conventional type, such as photoelectric cell responding to a broken beam, a capacitive device, or a mechanically actuated switch.

The heart of the timing circuit is a settable time/-count control 5 which provides an output pulse to a drive 7 for an associated air bar after a predetermined number of input pulses from a clock source 9 are counted. The desired count which the control 5 must achieve to produce an output pulse is present by a series of thumbwheel switches 11. The clock source 9 may be any one of many known digital or analog clocks. In a preferred arrangement, the clock source is a conventional A.C. line signal operating at a constant frequency of 60 cycles per second. The settable control 5 in the preferred embodiment is a counter-timer manufactured by the Industrial Controls Division of Eagle Signal Company of Davenport, Iowa and designated No. CT693A6.

As shown, the control 5 has first and second inputs 13 and 15 for receiving clock pulses either at the line frequency of the clock source 9, or at one-half the line frequency, depending upon the condition of a double pole, double throw switch shown generally as a relay 17. Division of the clock frequency is performed by a divide-by-two circuit 19 which may be any of many available types, both digital and analog. In the preferred embodiment frequency division is provided by a diode which passes only the positive half wave pulse of the line signal from the clock source 9, while both the positive and negative half wave pulses are applied to the input 13 of the counter 5.

The count set into the thumbwheel switches 11 of the control 5 is chosen to be the number of counts which the counter will achieve if driven at the frequency of the clock source 9 while a point on the conveyor travels from the sheet sensor 3 to an air bar. Since the conveyor speed is constant and the clock source 9 operates at a constant frequency, the setting of the control 5 will normally be fixed for any given application.

Since the front edge of the sheet to be folded actuates the sensor 3 to initiate the counting of pulses in the control 5, it is clear that the air bar would be actuated by the output pulse from the control 5 at the time when the front edge of the sheet reaches the air bar if the control were allowed to run at the frequency of the clock source throughout its counting cycle. This would be undesirable, since the air blast from the air bar should occur not at the front edge of the sheet but at the center of the sheet.

Accordingly, means are provided to delay the air blast for a time sufficient to allow one-half of the sheet to pass over the air bar. This is accomplished by dividing the frequency of the clock source driving the control 5 by two while the object sheet is passing over the sheet sensor 2. Counting at full speed is resumed after the trailing edge of the sheet has passed sensor 3. This half-time counting at the beginning of the count cycle has the effect of delaying the completion of the count signal, and thereby the actuation of the driver 7, until one-half of the object sheet has passed over the air bar.

A typical sequence of operations is as follows. As the front edge of the object sheet passes the sensor 3, an output pulse from the sensor 3 is initiated. The initiation of this pulse operates on the COUNT INITIATE INPUT to the control 5 to initiate counting from zero at a frequency determined by the operative input 13 or 15. The output pulse from the sensor 3 also energizes the relay 17 to disconnect the clock source 9 from the input 13 of the control and to connect the pulses from the divider circuit 19 to the control input 15. The control 5 is thereby incremented at one-half its normal real-time frequency until the trailing edge of the object sheet passes the sensor 3, at which time the relay 17 is deactivated. Thereafter, the control 5 is driven from the clock source 9 directly and continues to count up toward the preset count established with the thumbwheel switches 11. When the control 5 achieves its preset count an output signal is provided therefrom to actuate the air bar driver 7 and create an air blast precisely at the middle of the object sheet. Simultaneously, the control 5 resets itself to zero and remains inactive until the next sheet produces a pulse at the count initiate input. Of course, this entire process occurs within seconds or fractions of a second.

It is seen from the foregoing that while the count achieved by the control 5 will always be the same regardless of the sheet length, the time during which the control is incremented and therefore the time interval between the actuation of the sensor and air bar will vary with the length of the sheet being folded.

Referring now once again to the specific elements of apparatus 10 it will be noted from FIG. 3 that the first sheet sensor comprising electric eye 30 is mounted on a supporting stanchion 32 which is in turn secured to a transverse support 34. Lens 36 of the electric eye 30 from which a light beam passes is located so as to be disposed in a gap between two adjacent continuous ribbons 22 of the feed conveyor 24. Accordingly, when the leading edge of a foldable article such as a sheet 20 passes over the eye 30 the beam is interrupted thereby actuating time/count control **5*a* mounted in left side frame 12 (see FIG. 5). Control 5*a* which is of the type previously discussed in conjunction with FIG. 8 instantaneously begins to count up to the preset count after passage of the sheet over the eye lens 36, and since such controls are accurate to within 0.01 of a second the precise center of sheet 20 will be engaged by a blast of air from bar 40 in the manner seen in FIG. 2**.

As above mentioned with respect to FIG. 8, since the length of time which it takes the sheet 20 to pass over the electric eye 30 is an accurate measure of the length of the sheet, and since the ribbons 22 of the feed conveyor 24 are moving at a constant rate of speed, being driven by motor 51 (FIG. 1), through drive chain 21 disposed in the left side frame 12 of apparatus 10 (FIG. 9), the time interval that it takes for an article to pass from the electric eye 30 to air bar 40, see FIG. 5, disposed adjacent the distal end of the upper feed conveyor, may be readily determined.

Such time interval is a constant number of counts which is entered in control **5*a* and is counted out with an initial delay equal to the time interval which it takes for one-half the sheet 20 to pass over the electric eye 30 occasioned by "half-time" counting during the interval the sheet activates the sensor. Following expiration of this total "count" or time interval, a coil of solenoid 29**

(FIG. 5) is actuated by a signal from control 5a allowing an air blast to emit from air bar 40. The blast drives the middle of sheet 20 onto the upper surface of underlying conveyor 42, see FIGS. 4 and 5. Resulting half-folded sheet 20a (FIG. 2) will continue downwardly, supported on the continuous tapes 22 of conveyor 42 until the leading edge thereof depends by gravity from the lower end thereof.

In the course of initially moving over conveyor 42, actuator 43 of switch 44 is engaged, see FIG. 4. Switch 44 comprises a second sheet sensor which in turn actuates second time/count control 5b, see FIG. 5, also mounted in left sidewall frame panel 12 adjacent timer 5a. Switch 44 actuates control 5b in the same manner as electric eye 30 functioned in conjunction with control 5a and in a manner detailed in the above discussion of FIG. 8. The time interval or "count" it takes an article to travel from switch sensor 43 to air bar 48 is entered in control 5b and the counting out of this count is at "half-time" while the sheet 20a is in engagement with switch actuator 43. Such half-time count effects a delay equivalent to the precise time it takes one-half of such a sheet 20a to pass over switch 44.

It should be noted at this time that electric eye 30 is preferably employed in conjunction with measurement of the unfolded sheet 20, for if a switch actuator employed for sheet engagement rather than electric eye 30, a light-weight sheet might not have adequate body to trip a projecting switch arm instantaneously when engaged by its leading edge. However, after sheet 20 has been folded in half on upper feed conveyor 24, the double thickness of the transversely folded sheet 20a (see FIG. 2) is of adequate body so that there is no problem in instantaneous actuation of the arm on switch 44 illustrated in FIG. 4.

To insure the absence of adhesion of sheet 20a to the surface of the lower runs of tapes 22 of feed conveyor 24, as by static electricity, stripper fingers 53 mounted on a transverse support rod 45 (see FIG. 4) are employed insuring article disposition on the tapes 22 of conveyor 42. Stripper fingers 47 are mounted on rod 49 adjacent the lower discharge end of conveyor 42 to assure disengagement from the tapes of conveyor 42 so as to drop perpendicularly in front of air bar 48. Fingers 47 are also illustrated in FIG. 3.

Accordingly, control 5b is actuated to measure the length of the half-folded sheet 20a of FIG. 2 as determined by the interval between engagement of the feeler arm 43 of switch 44 by the leading edge of folded sheet 20a and disengagement of switch feeler 43 when the trailing edge of folded sheet 20a leaves engagement therewith.

Conveyor 42 is driven at exactly the same speed as conveyor 44, both conveyors being driven by a main drive motor 51 (see FIG. 9), through a common drive chain 53 engaging sprockets of drive rollers of conveyors 24, 42 and 50. The time interval which will be expended in the course of the sheet 20a passing from switch 44 to lower air bar 48 will be a constant time which is entered in control 5b. Control 5b will then activate a coil of solenoid 59 (FIG. 4) to permit an air blast from air bar 48 whereby the mid-point of the half-folded sheet 20a may be urged onto horizontal third conveyor 50, see FIGS. 2, 4 and 5, resulting in a sheet 20b, see FIG. 2 which has been transversely folded twice.

Third conveyor 50 which moves from the front to the rear of the apparatus 10 on a horizontal plane, employs continuous tapes 22, the upper runs of which slidably move over supporting planar plate 52 as is most clearly seen in FIG. 5. Located in alignment with the central longitudinal axis of conveyor 50 are counter-rotating pinch rolls 54, driven by a motor and chain arrangement, see FIG. 10. Sprockets 61 of rolls 54 are driven in opposite directions of rotation by chain 63 with the assistance of idler sprocket 65. As will also be seen in FIG. 10, drive chain 63 driven by output shaft 5 of speed reducer 69 driven by motor 79 also engages sprocket 81 driving lowermost conveyor 68 seen in FIG. 5. One roll 54 is seen in side elevation in FIG. 4.

Disposed above the bite or nip of the pinch rolls 54 is an air bar 56, see FIG. 5. Upon the leading edge of sheet 20b engaging switch actuator 58 after leaving engagement with actuator 60 (FIG. 5), third conveyor 50 is stopped by means of brake 83 which engages drive roller 85 of conveyor 50 (FIG. 11), and is pivotally driven into operative and inoperative positions by penumatic piston and cylinder unit 87. Although drive chain 21 constantly drives drive sprocket 89s (FIG. 9) of third conveyor 50, during normal apparatus operation a clutch arrangement enables sprocket 89 to rotate while conveyor 50 is braked by unit 87 of FIG. 11. It is necessary that conveyor 50 be stationary in the course of the cross-fold to prevent forward movement of the straddling half portions of the sheet 20b in the course being drawn into the bite of the pinch rolls 54. After the twice folded sheet 20b is at rest, a solenoid 57 (FIG. 4) opens to allow a blast of air to pass through openings in the bottom of air bar 56 driving the center of the sheet 20b down between the counter-rotating pinch rolls 54 forming a cross-fold in the twice transversely folded sheet 20b and resulting in a sheet 20c, see FIG. 2.

It will be noted from FIG. 5 that in addition to switch actuators 58, actuators 60 and 62 are also illustrated in axial alignment with the bite of the counter-rotating pinch rolls 54. In the event that a sheet 20b exceeds an article length which may be folded by pinch rolls 54 without jamming, such excessively long sheet would simultaneously engage actuators 60 and 58; simultaneous actuation of switch actuators 60 and 58 deactivates the cross-folding means preventing passage of air to the bar 56. The sheet 20b would then bypass pinch rolls 54 and be discharged from the rear of third conveyor 50. Thus switch actuators 60 and 58 comprise a safety system preventing excessively long sheets from being driven into the nip of pinch rolls 54, resulting in forcible jamming of sheets in the pinch rolls and sheet damage.

It will also be noted from FIG. 5 that an addition to the aligned switch actuators 60 and 58, there are three substantially transversely aligned switch actuators 62, 64 and 66; central actuator 62 may be disposed slightly closer to the feed end of conveyor 50. Should either of the side switch actuators 66 or 64 be engaged by the leading edge of a twice folded sheet 20b before engaging central switch actuator 62, such switch actuator engagement will indicate that the leading edge of the twice folded sheet 20b is improperly transversely aligned and therefore askew, and in improper condition for entering the bite of the pinch rolls 54. Engagement of actuator 64 or 66 without actuator 62 being first engaged will therefore deactivate the entire cross-folding system, allowing the twice folded sheet to discharge from the rear of conveyor 50 without being drawn into the counter-rotating pinch rolls 54, and avoid possible jamming and damage to the foldable article.

Following cross-folding of the sheet into the form 20c illustrated in FIG. 2, it is driven onto the continuous ribbons 22 of fourth conveyor 68 illustrated in FIG. 5 extending from beneath the pinch rolls 54 to discharge opening 16 in sidewall 12 of apparatus 10 as seen in FIG. 1 of the drawing. Similarly to the tapes 22 of third conveyor 50, the upper runs of continuous tapes 22 of the fourth conveyor slidably engage a smooth surfaced support plate 70 in the course of moving to the left as viewed in FIG. 5. In the course of being conveyed, the leading edge of the cross-folded sheet 20c is carried over fixed inclined fingers 72, see FIG. 6, after engaging a first switch actuator 74.

Following engagement with a second switch actuator 76, the leading edge of sheet 20c will ride up the smooth surface of gripping plate 78 whereafter plate 78 will be pivoted from the phantom line position illustrated in folding station 80 of FIG. 6 into the full line position, by means of air cylinder 82, connected linkage 84 and pivot bar 86. Slots 99 (FIG. 6) are formed in plates 78 illustrated in section through the slot in FIG. 6 allowing pivotal movement of actuators 76 into the plane of the plates and upward pivotal movement of the plates 78 without plate-actuator engagement. The leading edge of the sheet 20c which has moved up the smooth surface of plate 78 will then be clamped against fixedly positioned resilient pad 88 as illustrated in folding station 80 of FIG. 6. Following disengagement of the trailing edge of the sheet 20c with switch actuator 74, air cylinder 82 will be actuated to drop plate 78 into the lowered position.

Following such buckle fold as occurs in FIG. 8, the sheet 20c as appearing in FIG. 2 will have the leading edge drop on the trailing edge in which condition resulting sheet 20d will be carried by the tapes of the fourth conveyor 68 into folding station 90 of FIG. 6. In station 90 the two switch actuators 74 and 76 are actuated as previously described with respect to station 80. Sheet 20d will be folded into a final sheet configuration 20e (see FIG. 2) wherein the leading edge of sheet 20d is dropped upon the trailing edge thereof.

The fourth and final conveyor 68 then discharges the folded sheet 20 through discharge opening 16 onto discharge tapes 92, see FIG. 7, extending through apparatus discharge opening 16 (see FIG. 1). The speed of the tapes 92 is sufficient to slidably urge sheet 20e over spaced supporting fingers 94 of stacking platform 18. The interval between the fingers 94 which are of small diameter is such that they extend through the intervals between the sheet discharging tapes 92 as seen in FIG. 7. The speed of the discharge tapes 92 is precisely the same as the speed of the fourth conveyor 68 of FIG. 5 since the illustrated tapes 92 engage roller 96 thereof.

Also, the speed of the tapes 92 slidably driven article 20e across the upper surface portions of the fingers 94 until stop surface 102 of the stacker wall 106 is engaged. The leading longitudinal edge of the sheet 20e is then aligned against such stop surface.

Prior to striking the surface 102, the sheet 20e trips switch actuator 100 thus energizing a solenoid (not illustrated) to substantially instantaneously reciprocate the fingers 94 and the integral platform 18. One end of transverse bar 98 from which fingers 94 extend, engages rod 110 of a pneumatic piston and cylinder unit 112, seen in FIG. 7. The air input for unit 112 is controlled by the solenoid activated by switch 101.

The distal ends of the stacking fingers 94 are spaced from stop surface 102 in the extended position in the manner illustrated in FIG. 7. Thus, a foldable article when aligned against stop surface 102 already has actuated the fingers to initiate their retracting step, and as a result the sheet is instantaneously aligned and allowed to drop in a vertical plane without twisting or crumpling. Thus, when dropping in a vertical plane, sheet 20e is simultaneously aligned against stop surface 102 and dropped through a finger-wall gap larger than that illustrated ih FIG. 8. Also, in view of the extremely small surface area of the sheet 20e which the supporting fingers 94 of the platform engage, and because of the substantially instantaneous movement of the fingers following tripping of the switch actuator 100, the sheet 20e is further assisted in dropping in substantially the vertical plane onto underlying delivery plate 116 over which horizontal continuous tapes 118 slidably move. The tapes 118 may then discharge the final folded sheet 20e unto a receiving platform 120 most clearly seen in FIG. 1.

If desired, a counter may be employed in conjunction with the motor driving tapes 118, so that after a predetermined number of reciprocations of the stacking platform 18 the motor driving discharge tapes 118 may be actuated. Such motor may be stopped by either a self-contained timer or a switch actuated by the sheets when they reach the discharge platform 20. Kamberg et al U.S. Pat. No. 3,260,518 discloses a suitable counting and relay means for use with a conveyor such as that defined by tapes 118.

It is thus seen that an efficient folder construction has been provided which utilizes a minimum of floor space by utilization of inclined first and second conveyors employed to effect transverse folds when the sheet is in its largest states.

As has also been described in detail above, five folds may be effected in an efficient manner in the course of a foldable article proceeding through the folder described. The provided apparatus is composed of a minimum number of parts requiring little maintenance and repair. The apparatus described in detail is possessed of a number or proving means which prevent jamming of oversized or misaligned sheets in the cross-folding means described in conjunction with the third conveyor of the apparatus.

The novel stacking apparatus disclosed for use in conjunction with the provided folder is of extremely simple design. By virtue of the novel arrangement of its stacking fingers and the substantially instantaneous retraction of such fingers before the leading edge of the finally folded sheet is aligned by a stop surface, dropping of such sheet in the vertical plane results without the need for tamping means, stripping means and other apparatus components normally employed of stackers of the type disclosed.

It has also been made apparent that the novel system controlling the first two folds effected by air bars 40 and 48 allows precise folds to be constantly formed by the apparatus disclosed.

It is believed apparent from the foregoing description that structural additions to and modifications of the apparatus described may be made, which will not withdraw the resultant apparatus from the spirit of this invention. For example, smaller pieces may be folded without the need for folding stations 80 and 90 illustrated in FIG. 6 which may be deactivated by switches disposed at the feed end of apparatus 10. Also, the entire cross folder system may be deactivated by a switch at the apparatus feed end. It will be noted from FIG. 1 that various safety grills 124 are disposed adjacent certain moving parts so as to prevent entanglement of portions of foldable articles being processed and also to prevent injury to attendants feeding the folder 10. Also, the specific configuration of the platform supporting elements may vary from the illustrated fingers 94 in the stacker 18 and still function to advantage if adapted to support the foldable article in a desired planar condition while engaging a small fraction of the surface supported. Still further, the controls 5*a* and 5*b* may employ a circuit other than halving circuit 19 to initially divide the foldable items other than in half.

This invention, therefore, is to be limited only by the scope of the appended claims.

What is claimed is:

1. In a folding apparatus the combination comprising article folding means adapted to be mounted above a supporting surface; article sensing means; conveyor means for moving a foldable article at a constant speed between said article sensing means and said article folding means in a fixed period of time; said article sensing means being disposed adjacent the conveyor path and being sensitive to passage thereby of the article leading and trailing edges; control means adapted to be activated following receipt of a signal from said article sensing means while sensing a foldable article; said control means comprising a time/count control adapted to count out time at a normal rate and at a less than its normal rate; said control having a count entered therein corresponding to said fixed period of time; said time/-count control emitting a signal for activating said folding means after said time/count control has counted out said count entered therein; the entered count being counted out at said rate less than its normal rate while activated by said article sensing means and said entered count being counted out at said normal rate following passage of the foldable item from engagement with said sheet sensing means; an AC time signal having positive and negative half wave pulses operating at a frequency of 60 cycles per second driving said time count control; said time/count control counting the positive half wave pulse only of said time signal during the interval the article sensing means senses the foldable article and thereafter counting both the positive and negative half wave pulses of said time signal until said time/count control has counted out the count entered therein.

2. In a method for imparting a fold to a predetermined portion of a foldable item while moving at a constant speed from an item sensor toward a folding means for effecting such fold in said item, the steps comprising measuring the time interval expended in the course of the leading edge of said item moving at such constant speed between said sensor and said folding means; entering counts equivalent to such time interval in a timer control for said folding means; said timer control being adapted to activate said folding means by means of a signal; activating said folding means by a signal from said timer control following reception of an energizing signal from said sensor after the passage of a time period equivalent to that time consumed by said predetermined portion of the foldable item to be folded moving past the sensor, combined with said entered time interval; driving said timer control during passage of said time period by means of an AC time signal having positive and negative half wave pulses and operating at a frequency of 60 cycles per second; said timer control counting one of said half wave pulses only during the interval the sensor means the foldable article and counting both of said half wave pulses during the remainder of the entered time interval until said time interval has been counted out of the time control.

3. In a folding apparatus the combination comprising article folding means adapted to be mounted over a supporting surface; article sensing means, an upwardly inclined conveyor means for moving a foldable article along an axis of movement at a constant speed between said article sensing means and said article folding means disposed at an upper conveyor discharge end in a fixed period of time; the angle of inclination of said conveyor and the height of said discharge end above said supporting surface being such that a leading foldable article portion comprising over one-half the length of said foldable article as measured along said conveyor axis of movement may drop by gravity from the discharge end of said conveyor and hang vertically while supported by said conveyor by means of a trailing foldable article portion thereon without dropping whereby wrinkles are removed from said foldable article leading portion; said article sensing means being disposed adjacent the conveyor path and being sensitive to passage thereby of the article leading and trailing edges; control means adapted to be activated following receipt of a signal from said article sensing means while sensing a foldable article; said control means comprising a time/count control adapted to count out time at a normal rate and at a less than its normal rate; said control having a count entered therein corresponding to said fixed period of time; said time/count control emitting a signal for activating said folding means after said time/count control has counted out said count entered therein; said entered count being counted at said rate less than its normal rate while activated by said article sensing means and counting out said entered count at said normal rate following passage of the foldable item from engagement with said sheet sensing means; a clock source, comprising an A.C. time signal driving said time/count control and operating at a constant frequency of 60 cycles per second; said source having the frequency thereof divided by two during the interval the article sensing means senses the foldable article whereby said counter is driven at half speed during said interval.

* * * * *